US005647545A

United States Patent [19]

Conner

[11] Patent Number: 5,647,545

[45] Date of Patent: Jul. 15, 1997

[54] PORTABLE CRUSHER FOR CONCRETE

[75] Inventor: Edward L. Conner, Strongsville, Ohio

[73] Assignee: Ohio Machinery Co., Broadview Hts., Ohio

[21] Appl. No.: 544,828

[22] Filed: Oct. 18, 1995

[51] Int. Cl.[6] ..... B02C 21/02

[52] U.S. Cl. ..... 241/79; 241/101.75; 241/101.76

[58] Field of Search ..... 241/101.75, 101.76, 241/101.71, 79

[56] References Cited

U.S. PATENT DOCUMENTS

| | | | |
|---|---|---|---|
| 3,563,477 | 2/1971 | Schroeder et al. | 241/101.76 |
| 3,927,839 | 12/1975 | Quinn | 241/76 |
| 4,383,651 | 5/1983 | Couperus | 241/81 |
| 4,585,179 | 4/1986 | Tsuji et al. | 241/101.7 |
| 4,598,875 | 7/1986 | Bronson et al. | 241/78 |
| 4,655,402 | 4/1987 | Desourdy | 241/76 |
| 4,795,103 | 1/1989 | Lech | 241/77 |
| 4,881,691 | 11/1989 | Oldengott et al. | 241/101.5 |
| 4,951,885 | 8/1990 | Thus | 241/101.7 |
| 5,026,205 | 6/1991 | Gorski et al. | 404/72 |
| 5,161,744 | 11/1992 | Schoop et al. | 241/101.7 |

*Primary Examiner*—John M. Husar

*Attorney, Agent, or Firm*—Pearne, Gordon, McCoy & Granger LLP

[57] ABSTRACT

A crushing plant is carried on one trailer and a screening plant is carried on another trailer. A separate hopper for receiving material is supported on the crushing plant trailer. The trailers are positioned angularly with respect to each other. Conveyors on the trailers cooperate to move crushed material from a crusher to a screen. The screen classifies material and adequately crushed material is removed. Insufficiently crushed material is returned by conveyors to the crusher. The conveyors and other components are movable to permit transport of the trailers over public roadways.

6 Claims, 4 Drawing Sheets

PORTABLE CRUSHER FOR CONCRETE

BACKGROUND OF THE INVENTION

1. Field of the Invention

This invention relates generally to the field of concrete crushing, rock crushing, mining, and recycling of concrete and other materials, and specifically to a concrete crushing plant transportable over highway systems to construction and demolition sites.

2. Description of the Related Art

Portable crushing plants for rock, concrete and other demolition materials have been developed for applications where the quantity of material to be crushed at a particular site is limited. Highway portability is important, for example, in non-mining applications such as in building demolition or in clearing the wreckage following a natural disaster, such as an earthquake. However, high capacity machinery in a typical plant, rated in tons per hour, can often exceed the legal weight limits specified by the federal or state government for its roadways. This situation has been overcome, in part, by breaking down the plant into subcomponents that are separately transported to a new site and then reassembled. Typically, where the crusher is fed with a vibratory hopper/feeder, it has been a custom in large capacity plants to transport the vibratory hopper/feeder separately on a general utility trailer. At a new site, a heavy crane is used to lift the hopper/feeder from the transport trailer onto the framework of the main part of the plant. When a job is completed, this set-up process is reversed again using a heavy crane to lift the hopper/feeder from the main structure to a utility trailer. This set-up procedure, although commonly used, is very costly because of crane rental charges incurred at the beginning and end of a job. When a plant is only at a location for a short period of time, the crane rental charges can greatly increase the overall cost of the job.

Various crushing apparatus are shown in U.S. Pat. No. 4,383,651 to Couperus, U.S. Pat. No. 4,585,179 to Tsuji, U.S. Pat. No. 4,598,875 to Bronson, U.S. Pat. No. 4,655,402 to Desourdy, U.S. Pat. No. 4,881,691 to Oldengott, U.S. Pat. No. 4,951,885 to Thüs, U.S. Pat. No. 5,026,205 to Gorski, and U.S. Pat. No. 5,161,744 to Schoop, all incorporated herein by reference.

SUMMARY OF THE INVENTION

The present invention provides a portable crushing plant that offers a large production capacity and avoids costly and complicated set-up and take-down procedures, such as the use of a heavy crane to install the plant equipment.

In particular, the portable crushing plant includes a crusher disposed on a first movable vehicle; a classifier disposed on a second movable vehicle and adapted for classifying material according to size; a feed conveyor for carrying output material from the crusher to the classifier; and a return conveyor for returning oversize material from the classifier to the crusher.

The trailers are supported on ground engaging wheels. The crusher is disposed on the first trailer and has a side chute for receiving material. A plurality of jacks are adapted for elevating the first trailer. A swingable under crusher conveyor is disposed on the first trailer and under the crusher for conveying output material from the crusher. The first feed conveyor extends from beneath the crusher and is adapted for conveying material from the under crusher conveyor. The conveyor extends laterally from the trailer and is retractable. A hopper is supported on ground engaging legs and is adapted for being positioned over the first trailer so as to rest thereon when the first trailer is elevated. The hopper is adapted for classifying material received therein and discharges undersize material on the feed conveyor and discharges oversize material to the crusher.

The second movable trailer is adapted for being positioned adjacent the first trailer so as to extend laterally therefrom. A plurality of jacks are adapted for elevating a forward end of the second trailer. A second feed conveyor is adapted for communicating with the first feed conveyor. A funnel directs material from the first feed conveyor to the second feed conveyor. A magnetic separator is disposed adjacent the second feed conveyor and adapted for removing magnetic material from the second feed conveyor. The separator is pivotably mounted for movement between travel and operating positions. A vibratable screen assembly is adapted for receiving material from the second feed conveyor and has screens adapted for classifying the material according to size. A discharge conveyor is disposed below the screen assembly and adapted for conveying output material passed by the screen assembly. Lateral conveyors are disposed at return ends of the screens and adapted for receiving oversize material therefrom. A return conveyor is adapted for receiving material from the lateral conveyors and conveying the material to the side chute of the crusher. The return conveyor is pivotably mounted to the second trailer. A retractable cable is disposed between the second trailer and the return conveyor and adapted for pivoting the second feed conveyor between a travel position and an operating position. A shroud is disposed adjacent the lateral conveyors and mounted for movement with an end of the return conveyor to partially enclose the lateral conveyors.

DESCRIPTION OF THE PREFERRED EMBODIMENT

Figure 1:
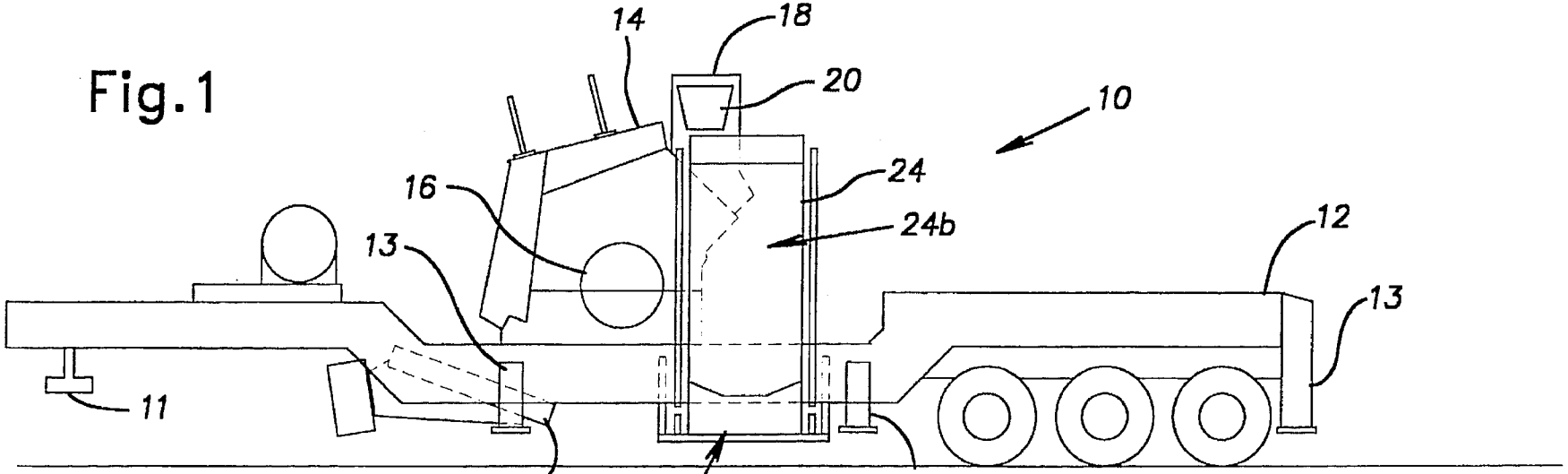
FIG. 1 shows a side elevation of a first trailer equipped with a crusher and conveyors in a retracted state according to the invention.
Figure 4:
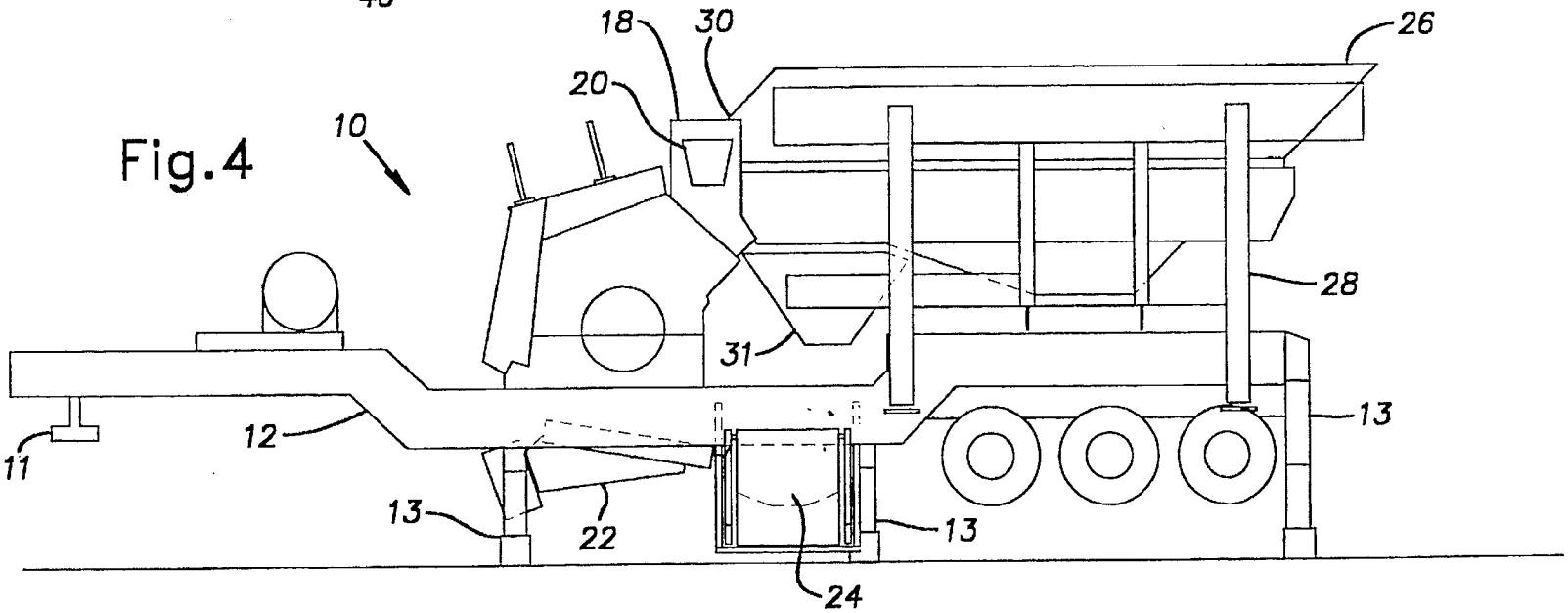
FIG. 4 shows a side elevation of the first trailer in an operative state with the hopper installed thereon.

Referring to FIG. 1, components of a crushing plant 10 are mounted on a first movable trailer 12. Preferably, the trailer 12 is provided with ground engaging wheels and is adapted for being pulled by a tractor over streets and highways. A modified flatbed trailer with a pin 11 for connecting to a tractor is suitable. Jacks 13 or extendable legs are provided for elevating the trailer 12 to a stable operative position with the wheels off the ground, as shown in FIG. 4. In the operative position the trailer load is substantially removed from the wheels. A crusher 14 is provided about midway along the length of the trailer 12. Suitable crushers are well known in the art and include an electric motor or combustion engine 16 that powers a rotating member (not shown). The rotating member is adapted for disintegrating material, such as concrete, into smaller chunks. The crusher 14 is provided with an inlet 18 adapted for receiving the material to be crushed. The inlet 18 is also provided with a side chute 20 adapted for receiving material from a side of the crusher 14 and directing the material into the inlet 18, as discussed below.

The first trailer 12 is also provided with an under crusher conveyor 22 adapted for sliding or pivoting between a retracted position, shown in FIG. 1, and an operative position, shown in FIG. 4. In the retracted position, the under crusher conveyor 22 provides adequate clearance from the ground to permit travel of the trailer 12. A first feed conveyor 24 or auxiliary feed conveyor is disposed on a side of the first trailer 12. A relatively horizontal part 24*a* of the feed conveyor 24 extends under the trailer near the crusher 14. The feed conveyor 24 is mounted for vertical movement on the trailer between a retracted position, shown in FIG. 1, and an operative position, shown in FIG. 4. In the retracted position, the feed conveyor 24 provides adequate clearance from the ground to permit travel of the trailer 12. An inclined part 24*b* of the first feed conveyor 24 extends upwardly from the horizontal part 24*a* past a side of the trailer 12. The inclined part 24*b* is pivotably mounted at the horizontal part for movement between a retracted position, shown in FIG. 1, and a sloped, operative position, shown in FIGS. 4 and 5. The conveyors 22, 24 described above and others described below are generally conventional in construction, each having an endless belt suitable for transporting crushed material from one location to another.

Figure 2:
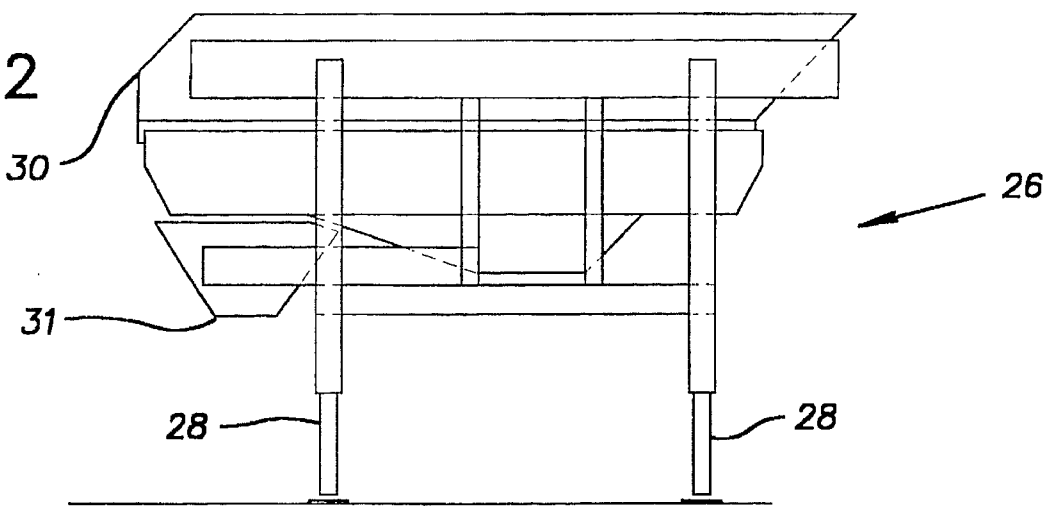
FIG. 2 shows a side elevation of a hopper according to the invention.
Figures 5, 6:
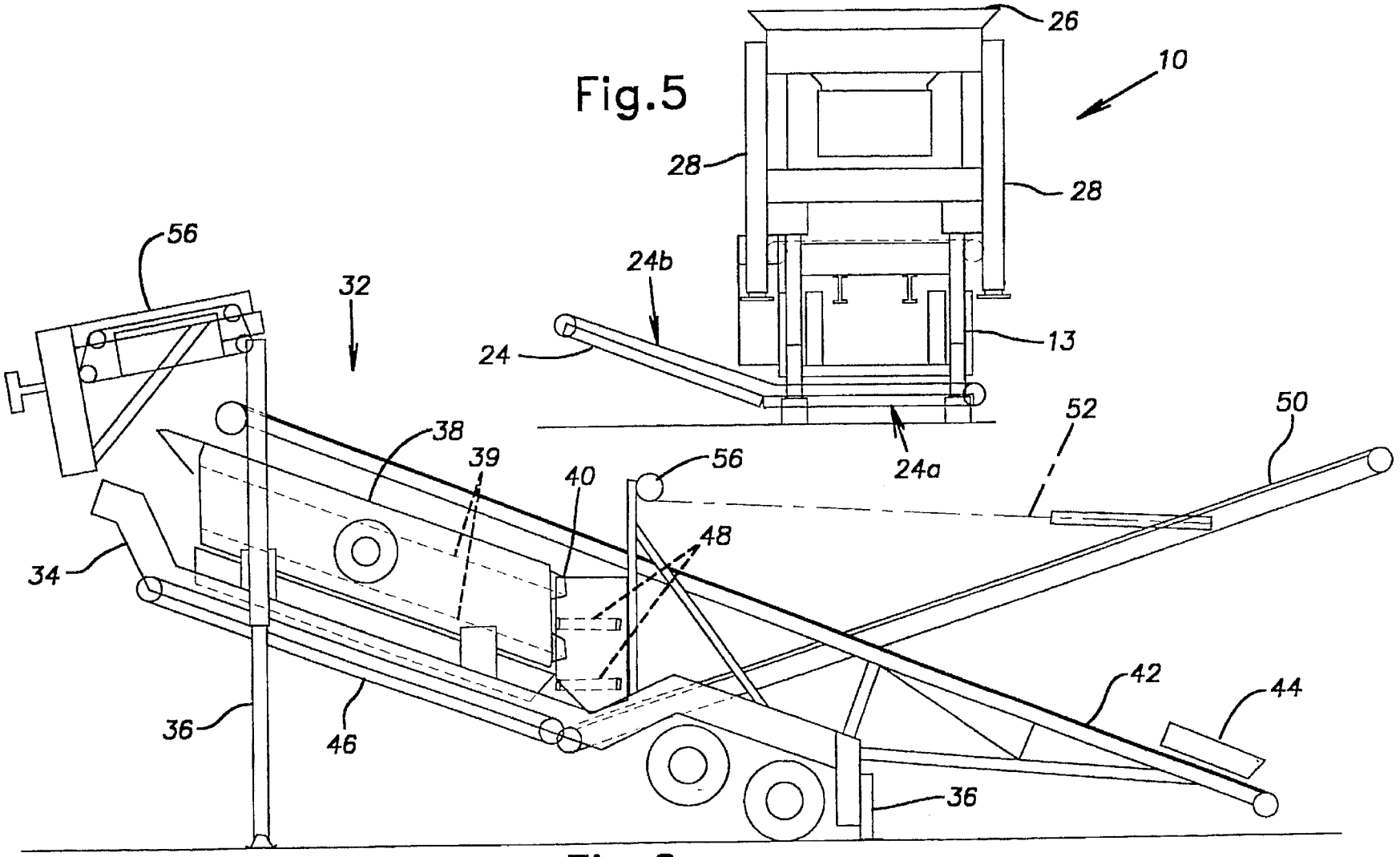
FIG. 5 shows a rear end elevation of the first trailer shown in FIG. 4.
FIG. 6 shows a side elevation of the second trailer in an operative state.
Figure 7:
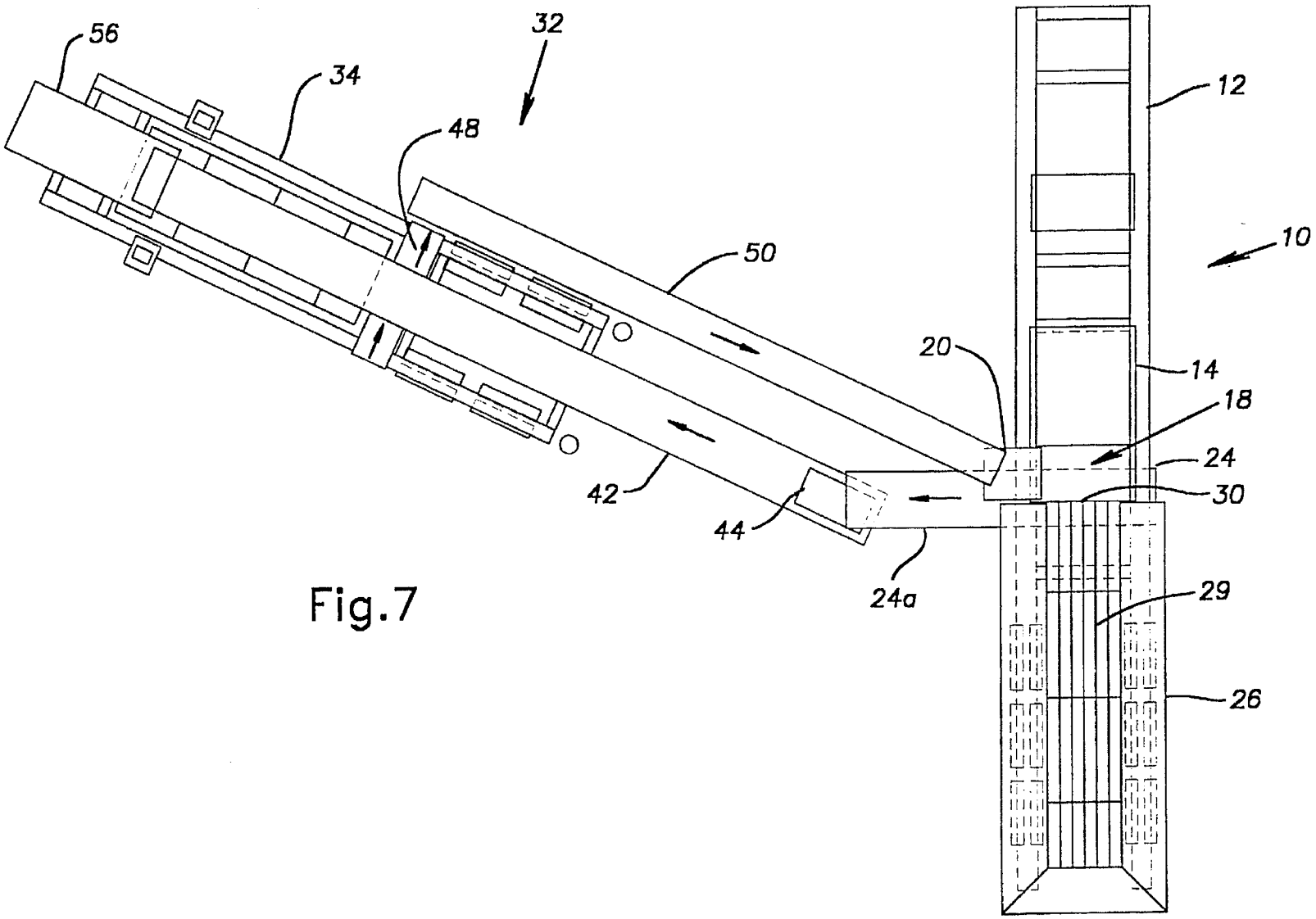
FIG. 7 shows a top plan view of the trailers assembled to form a crushing and screening plant according to the invention.

Referring to FIGS. 2 and 7, a vibratory hopper 26 is supported on four extendable legs 28 or jacks. The hopper is adapted for receiving material from a front end loader, for example, and provided with a screen 29 or "grizzly deck" adapted for classifying material by size. The hopper 26 is sized so as to be portable on a semi-trailer and the legs 28 are spaced so as to be capable of straddling the first trailer 12, as shown in FIGS. 4 and 5. The hopper 26 is provided with an outlet end 30 adapted for communicating with the inlet 18 of the crusher 14 so as to direct oversize material from the hopper into the crusher. Undersize material that does not require crushing is passed by the screen 29 and falls through discharge port 31.

Figure 3:
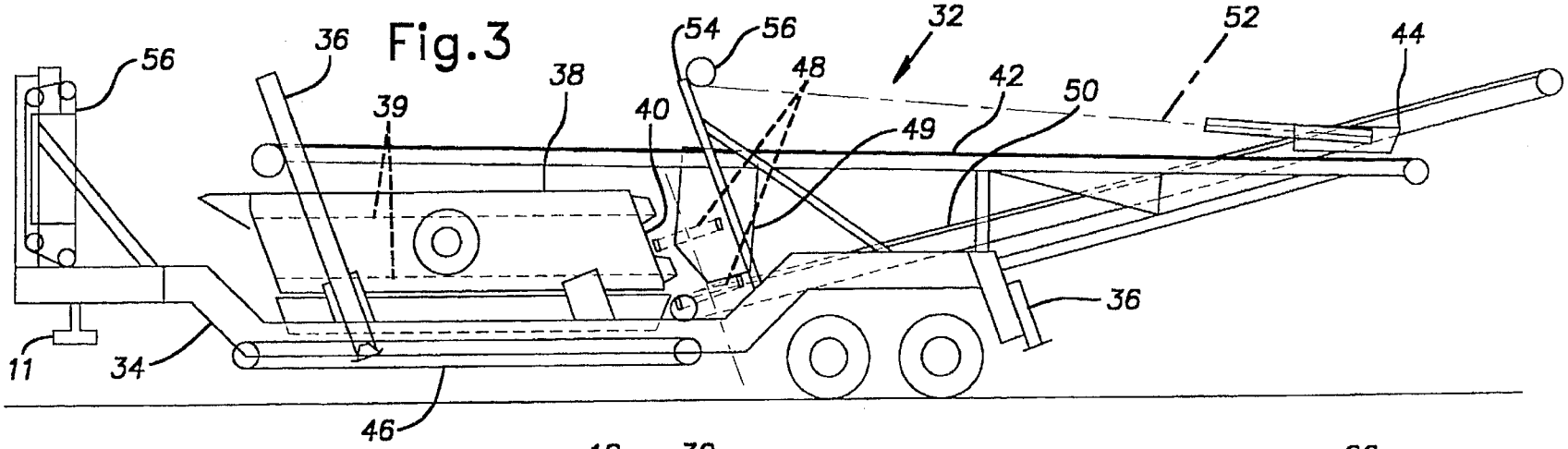
FIG. 3 shows a side elevation of a second trailer equipped with a screen and conveyors in a retracted state according to the invention.

Referring to FIG. 3, a screening plant 32 is disposed on a second trailer 34. Preferably, the second trailer 34 is provided with ground engaging wheels and a pin 35 and is adapted for being pulled by a tractor over streets and highways. A modified flatbed trailer is suitable. Jacks 36 or extendable legs are provided for elevating the trailer 34 to a stable operative position, as shown in FIG. 6. A screen assembly 38 is provided about midway along the length of the second trailer 34. Suitable screen assemblies are well known in the art and typically comprise a vibratory enclosure supporting one or more screens 39 or "grizzly decks" adapted for passing material smaller than a certain size and directing larger, oversize material to a return end 40 of the enclosure.

A second feed conveyor 42 is provided on the second trailer 34 and terminates over an input end of the screen assembly 38. A funnel 44 disposed at an end of the second feed conveyor 42 is adapted for receiving material from the first feed conveyor 24 and directing it to the second feed conveyor 42. A discharge conveyor 46 is disposed below the screen assembly 38 for collecting and transporting the material passed by the screens. One or more lateral conveyors 48 are located across the return end 40 of the screen assembly 38. These are located so as to receive and convey material not passed or partially passed by the screen assembly 38. A shroud 49 is disposed around the lateral conveyors 48 to prevent spillage. A return conveyor 50 is located at an end of the lateral conveyors 48 and adapted to receive material therefrom. The return conveyor 50 extends rearwardly along a side of the second trailer 34. An end of the return conveyor 50 is movably supported by a retractable cable 52 extending from a stanchion 54 mounted on the trailer 34. The cable 52 is retractable by a winch 56, for example. A magnetic separator 56 is pivotably mounted at a front end of the second trailer 34 and adapted to be positioned over an end of the second feed conveyor 42 over the screen assembly 38.

Erection and operation of the crushing plant 10 and screening plant 32 can best be understood by reference to FIGS. 4 through 7. As shown in FIG. 4, the first trailer 12 is backed under the hopper 26, which is supported on the ground at a location where the crushing is to occur. The trailer 12 is positioned so that the hopper outlet end 30 is disposed above the crusher inlet 18 and the discharge port 29 is over the first feed conveyor 24. The first trailer 12 is elevated on the jacks 13 to support the hopper 26 on the trailer. The first feed conveyor 24 is lowered and the under crusher conveyor 22 is moved beneath the crusher 14 so that an end of the under crusher conveyor is located above the horizontal part 24*a* of the first feed conveyor.

As shown in FIG. 7, the second trailer 34 is moved adjacent the first trailer 12 so that longitudinal axes of the trailers 12, 34 intersect at about a 70° angle. The end of the return conveyor 50 is positioned over the side chute 20 of the crusher 14. As shown in FIG. 6, the front end of the second trailer 34 is pivoted upwardly and supported by the jacks 36 while the cable 52 is retracted to pivot the return conveyor 50 upwardly. Thus, the second feed 40 and return 50 conveyors have non-intersecting longitudinal axes generally forming an "X." The shroud 49 moves with the return conveyor 50 to partially enclose the lateral conveyors 48. Pivoting the front end of the trailer 34 upwardly lowers the end of the second feed conveyor 42 and the funnel 44 at the rear of the trailer. As shown in FIG. 5, the inclined part 24*b* of the first feed conveyor 24 is pivoted downwardly from the generally vertical transport position so that the inclined part remains in an upwardly sloping position. The inclined part 24*b* terminates over the funnel 44. Referring to FIG. 6, the magnetic separator is pivoted over the end of the second feed conveyor 42.

The flow of operation is apparent from the assembly as shown in FIG. 7. Raw material to be crushed is loaded into the hopper 26 from where oversize material moves by vibration and gravity to the crusher 14 from the hopper outlet end 30 into the crusher inlet 18. The crusher 14 crushes the oversize material, which is discharged onto the under crusher conveyor 22 (FIG. 4). The material moves on the under crusher conveyor 22 to the first feed conveyor 24, which serves as an auxiliary feed conveyor for moving material to the second or main feed conveyor 40. Undersize material that does not require crushing is passed by the screen 29 and falls through the hopper discharge port 31 directly to the first feed conveyor 24. The magnetic separator 56 removes magnetic material and deposits it in a suitable receptacle (not shown) for reclaiming.

Referring to FIG. 6, non-magnetic material falls into the screen assembly 38. The screen assembly 38 vibrates and the material falls through the screens 39 therein according to size. Acceptably small material passes through the screen assembly 38 onto the discharge conveyor 46, which conveys the material upwardly to another receptacle (not shown) for transport and reuse of the crushed material. Oversize material that is not passed by the screen assembly 38 falls onto one of the lateral conveyors 48. Referring again to FIG. 7, the lateral conveyors 48 move the oversize material to the return conveyor 50, which returns the material to the side chute 20 of the crusher 14. The material is crushed again and repeats the cycle until it is sufficiently crushed to pass through the screen assembly 38 onto the discharge conveyor 46.

At the completion of a crushing and screening operation, the assembly steps are essentially reversed. The two trailers 12, 34 and hopper 26 are then ready for transport over public roadways.

The present disclosure describes one embodiment of the invention, however, the invention is not limited to this embodiment. Variations are contemplated to be within the spirit and scope of the invention and appended claims.

What is claimed is:

1. A portable crushing apparatus comprising:

a vibratory hopper having extendable legs permitting it to be temporarily supported from the ground;

a crusher disposed on a movable vehicle, said vehicle being adapted to be moved under the hopper while it is supported by the extendable legs on the ground and so that the crusher during operation receives material from the hopper; and a classifier disposed on a movable vehicle adapted for classifying material from the crusher according to size.

2. A portable crushing apparatus according to claim 1, wherein the movable vehicle associated with the crusher supports the vibratory hopper in an operative position.

3. A portable crushing apparatus comprising a trailer mounted crusher, a screen unit for classifying material by size, a feed conveyor for carrying crushed material discharged by the crusher to the classifier screen unit, a return conveyor for conveying oversize material from the classifying screen unit back to the crusher for additional crushing, a vibratory hopper for receiving material to be crushed and for transferring the received material to the crusher, the hopper being constructed and arranged to be transported to a work site on a trailer and including support members for supporting the hopper from the ground at locations straddling the trailer on which it is transported, the support members being arranged to support the hopper while the trailer on which it is transported to the work site is removed and while the trailer carrying the crusher is rolled beneath it.

4. A portable crushing apparatus according to claim 3, wherein said support members include depending extendable jacks assembled on the hopper.

5. A portable crushing apparatus according to claim 4, wherein said extendable jacks comprise four units, with two units disposed on each side of the trailer used to transport the hopper.

6. A portable crushing apparatus according to claim 3, wherein the trailer on which the crusher is carried includes jacks arranged to elevate such trailer when it is under the hopper so that it supports the hopper during operation of the apparatus.

* * * * *